United States Patent [19]

Brunner

[11] Patent Number: 4,916,787

[45] Date of Patent: Apr. 17, 1990

[54] KNOT CATCHER FOR YARNS AND THREADS

[75] Inventor: Heinz Brunner, Albstadt-Ebingen, Fed. Rep. of Germany

[73] Assignee: Sipra Patententwicklungs-und Beteiligungsgesellschaft mbH, Albstadt, Fed. Rep. of Germany

[21] Appl. No.: 173,152

[22] Filed: Mar. 24, 1988

[30] Foreign Application Priority Data

Mar. 28, 1987 [DE] Fed. Rep. of Germany ..... 3710345

[51] Int. Cl.[4] ..... D02J 3/14; B65H 63/06

[52] U.S. Cl. ..... 28/232; 28/236; 66/158

[58] Field of Search ..... 28/225, 226, 232, 235, 28/236, 237, 238; 66/158, 159; 57/353; 226/90; 242/36

[56] References Cited

U.S. PATENT DOCUMENTS

| | | | |
|---|---|---|---|
| 577,337 | 12/1897 | Wardwell, Jr. | 28/236 |
| 2,860,704 | 11/1958 | Mirick | 28/226 X |

FOREIGN PATENT DOCUMENTS

| | | | |
|---|---|---|---|
| 3136644 | 3/1983 | Fed. Rep. of Germany . | |
| 1951 | of 1853 | United Kingdom | 28/237 |
| 235928 | 6/1925 | United Kingdom | 242/36 |
| 325153 | 2/1930 | United Kingdom | 28/236 |

*Primary Examiner*—Werner H. Schroeder
*Attorney, Agent, or Firm*—Michael J. Striker

[57] ABSTRACT

Knot catcher for yarns and threads includes two rotary rollers spaced from each other to form therebetween a thread-receiving through opening which is limited at two ends thereof by two opposite walls of the housing of the knot catcher. The size of the opening can be adjusted by adjusting the rollers relative each other.

15 Claims, 2 Drawing Sheets

KNOT CATCHER FOR YARNS AND THREADS

BACKGROUND OF THE INVENTION

The present invention relates to a knot catcher for yarns and threads of the type in which a thread receiving opening of an adjustable cross-section is formed between two elements adjustable relative to each other.

In conventional knot catchers for textile machines of the type under discussion, the through opening is limited between two plates adjustable relative to each other. A slot between these plates provides for a lateral insertion of the thread into the through opening. The through opening is of a predetermined size so that a knot in the thread is not allowed to pass into said opening. Such a knot catcher has been disclosed, for example in the German patent publication DE-OS 31 36 644.

Known knot catchers with slotted or holed plates all have the disadvantage that the thread rubs against the stationary edge so that a thread is worn off while a fiber fuzz occurring can deposit and collect on the holed plates. Thus there is the danger that the fiber fuzz can also penetrate the thread-receiving through opening which would then be clogged and the thread would tear off.

SUMMARY OF THE INVENTION

It is an object of the present invention to provide an improved knot catcher for textile machines.

It is another object to provide a knot catcher which would not form fiber fuzz by itself and at which the fiber fuzz would not be collected.

Yet another object of this invention is to provide a knot catcher which forms a thread purifying and monitoring organ.

These and other objects of the invention are attained by a knot catcher for yarns and threads, comprising two elements adjustable relative to each other and forming between each other a thread-receiving through opening, said elements being two rotation-symmetrical bodies of which at least one is rotationally supported and at least one is adjustable relative to another rotation-symmetrical body to adjust a size of said through opening for insertion a thread thereinto.

The rotating bodies prevent the thread abrasion and thus the collection of thread fuzz in the region of the through opening. Bevelled friction surfaces are omitted. Thick spots in the passing yarn between two rollers due to compression are reduced. The advantage of the knot catcher of the invention resides in that it is lighter than conventional knot catchers and that it can be easily coupled with a switch-off device of the knitting machine.

Although it is known that yarns or threads are guided between two roller-type bodies. The thread in such known devices is tightly pressed against the rollers and such devices serve as thread-braking devices in thread supply installations or thread pulling arrangements and thus serve a purpose different from that of the device of this invention.

The rotation-symmetrical bodies may have cylindrical peripheral surfaces which form between each other said through opening and include rotation axles, and wherein wall means are provided extending perpendicular to said axles and limiting said through opening at two ends thereof.

Said wall means may be formed by two end flanges of one of said bodies.

The knot catcher may include a housing including two opposite walls, said wall means being formed by said two opposite walls.

Both rotation-symmetrical bodies or only one of them may be supported between said opposite housing walls.

The knot catcher may include a restoring spring and wherein one of said opposite walls supporting one of said bodies is adjustable against a force of said spring.

One of the opposite walls may have a guide slot, the rotation axle of one of said bodies being adjustable in said guide slot and fixable therein. The insertion of the thread into the knot catcher can be carried out through said guide slot.

One of the rotation bodies, namely the roller may be swingably supported either on a swinging arm or on the housing wall.

To change the size, e.g. the cross-section of the thread-receiving opening in order to adjust the knot catcher to different yarns or thread thickness, an adjusting element, eccentric to the rotation axle of the rotation-symmetrical body or roller, can support that roller so that, upon rotation of the eccentric adjusting element, the space between the rotation-symmetrical rollers and thus the size of said opening is adjusted.

The rotation axle of at least one of the rotationsymmetrical bodies can be adjusted in the guide slot and fixed therein.

In order to prevent a knot of the thread from passing through said opening and/or clogging the same by thread fuzz formed thereby, a flexible switch-off organ is provided, which has a stationary switch, said one of said rotation-symmetrical bodies being adjustably supported relative to said switch and adapted to actuate the latter against the force of said restoring spring.

The knot catcher can be also utilized as a thread guiding organ for a thread deflection because it has no edges of conventional knot catchers. A further advantage of the present invention is that the thread is detected and is guided, at the same time, in a predetermined direction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
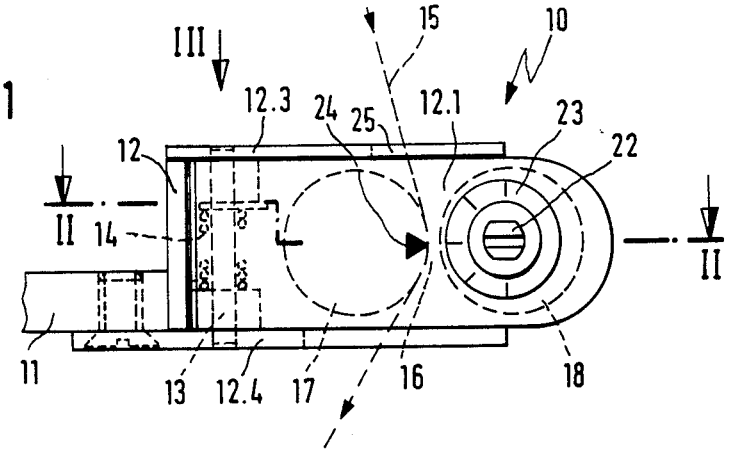
FIG. 1 is a side view of the knot catcher of the first embodiment of the invention.
Figure 2:
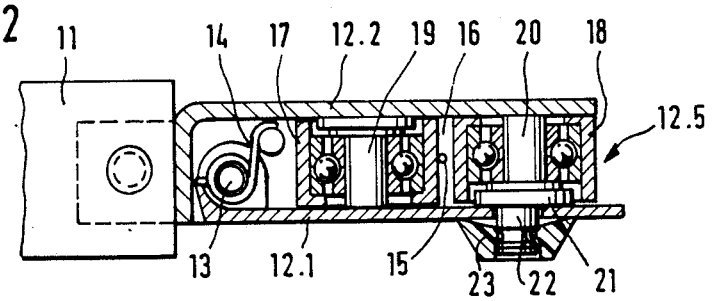
FIG. 2 is a sectional view taken on line II—II of FIG. 1.
Figure 3:
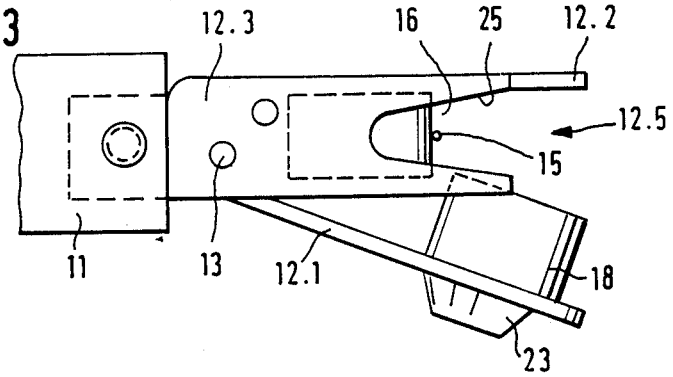
FIG. 3 is a top plan view as seen from arrow III of FIG. 1.

Referring now to the drawings in detail, and firstly to FIGS. 1 to 3 thereof a knot catcher 10 according to this invention includes a housing 12 secured to a supporting arm 11 and having a front housing wall 12.1, a rear housing wall 12.2, an upper housing wall 12.3 and a bottom housing wall 12.4. The front wall 12.1 of the housing is pivotally supported to pivot about an axle 13 extending between the upper and the bottom housing walls 12.3 and 12.4 against the force of a helical torsion spring 14 supported on the axle 13.

As can be seen from FIG. 3, front wall 12.1 is pivotable away from the remaining part of housing 12 to allow a thread 15 to be inserted from the open housing end 12.5 into a through opening 16 of the knot catcher 10, which through opening is formed between two rollers 17 and 18 which are supported as shown in FIG. 2 by ball bearings. A supporting pin 19 for the roller 17 is connected to the rear housing wall 12.2. The other roller 18 is positioned on a supporting pin 20 which is eccentric relative to an adjusting axle 22 and is anchored via an abutment or shoulder 21 and axle 22 in the pivotable front housing wall 12.1. Thereby roller 18 is also connected to front wall 12.1 and is pivotable therealong as seen in FIG. 3. A disc 23 having a scale thereon is clamped on the adjusting axle 22. One can determine on the scale of disc 23 the distance between the rollers 17 and 18 corresponding to the width of through opening 16, depending on the position of the marks on the scale of disc 23 relative to a marking arrow 24 provided on the front housing wall 12.1.

An open slot 25 is formed in the upper housing wall 12.3 at the open housing end 12.5. Slot 25 forms the limits of the through opening 16 relative to the width of the rollers 17, 18 and which has in the limiting region such a width that is smaller than the widths of both rollers 17 and 18. Such a lateral limitation of the through opening 16 relative to the width of the rollers can be also provided in the lower housing wall 12.4. Instead of the slot, other suitable guiding organs can be employed, for example an eyelet or a yoke. Slot 25 continuously ensures the correct position of thread 15 also during the insertion of the thread.

Figure 4:
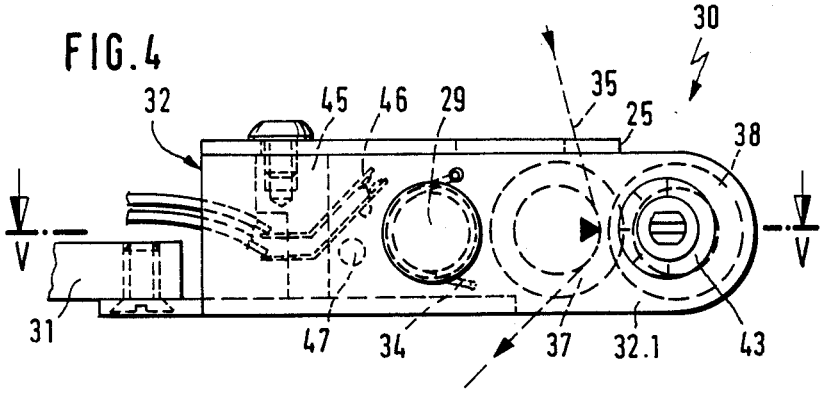
FIG. 4 is a side view of the knot catcher of the second embodiment.
Figure 5:
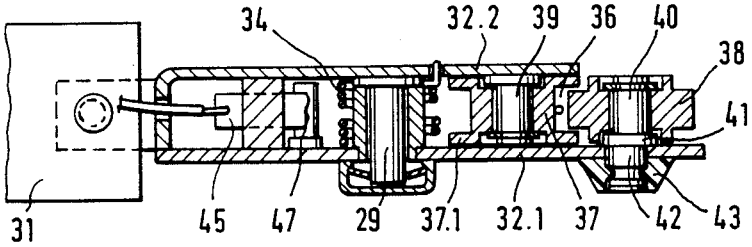
FIG. 5 is a sectional view taken on line V—V of FIG. 4.
Figure 6:
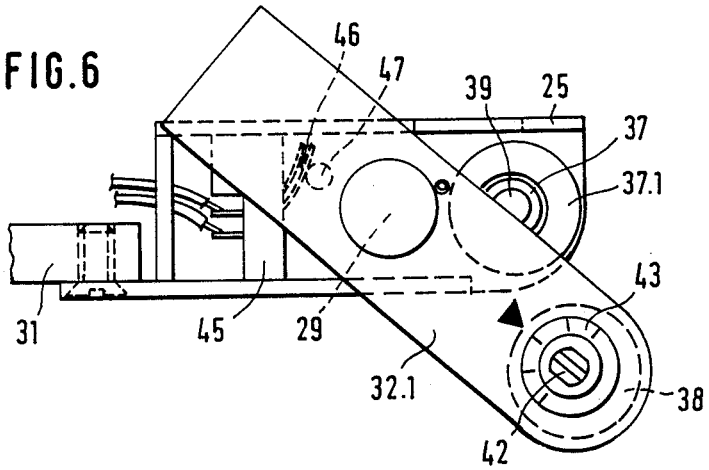
FIG. 6 is a side view of the knot catcher of FIG. 4 with a housing wall pivoted from the position shown in FIG. 4.

Referring now to FIGS. 4 to 6 which show the second embodiment of the invention, it will be seen that the knot catcher 30 has a housing arranged somewhat similarly to that of the embodiment of FIGS. 1–3. The front housing wall 32.1 of housing 32 connected to a supporting arm 31 is here, however, pivotable in its plane parallel to the stationary rear housing wall 32.2 about a central axial pin 29 against the force of a torsion spring 34 suspended on the pin 29. Also in this embodiment, one of the two rollers 37, 38 which limit therebetween a thread receiving through opening 36, namely roller 38 is arranged on the pivotable front housing wall 32.1 by means of supporting pin 40 provided with an abutment 41 and eccentric to an adjusting axle 42 positioned in the disc 43 having a scale as shown in FIGS. 4 and 6. The other roller 37 is supported on a pin 39 connected to the rear housing wall 32.2. Rollers 37 and 38 are shaped differently from each other. Roller 37 has flanges 37.1 at both ends thereof. Second roller 38 is laterally inserted between flanges 37.1 of roller 37 so as to enclose with roller 37 the through opening 36.

With the knot catcher 30, a larger knot available in thread 35 will not pass into the through opening 36. Such a knot would cause the forcible pivoting of roller 38. Thereby a thread disconnector 45 with a normally open switch contact 46 inserted in housing 32 can be actuated. The actuation of thread disconnector 45 is obtained by means of a switching pin 47 made of an electrically insulated material and connected to the front pivotable wall 32.1 of the housing. Pin 47, upon pivoting of the housing front wall 32.1, closes the switch contact 46, as shown by dotted lines in FIG. 6, so as to switch off the textile machine, to which the knot catcher 30 corresponds.

In place of the closed housing, the knot catcher can also support the rotation bodies, e.g. rollers which limit therebetween the thread receiving through opening on the simple pivotable arms. In order to change the width of the thread receiving opening, the axle of one of the rotation bodies can be adjustable and fixable in a guide slot.

It will be understood that each of the elements described above, or two or more together, may also find a useful application in other types of knot catchers differing from the types described above.

While the invention has been illustrated and described as embodied in a knot catcher, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A knot catcher for yarns and threads, comprising two elements adjustable relative to each other and forming between each other a thread-receiving through opening, said elements being two rotation-symmetrical bodies of which at least one is rotationally supported and at least one is adjustable relative to the other rotation-symmetrical body to adjust a size of said through opening for insertion of a thread thereinto, said two rotation-symmetrical bodies having cylindrical peripheral surfaces which form said through opening, rotation axles and two end flanges, said two end flanges providing wall means extending perpendicular to said axles and limiting said through opening at two ends thereof.

2. The knot catcher according to claim 1, wherein one of said rotation axles is an adjusting axle on which one of said rotation-symmetrical bodies is mounted eccentrically.

3. A knot catcher for yarns and threads, comprising:

two rotation-symmetrical bodies having cylindrical peripheral surfaces and rotation axles, said rotation-symmetrical bodies forming a thread-receiving through opening therebetween, at least one of said rotation-symmetrical bodies being rotationally supported and at least one of said rotational symmetrical bodies being adjustable relative to another of said rotation-symmetrical bodies to adjust a size of said through opening for insertion of a thread therein, and a housing having two opposite walls extending substantially perpendicular to said axles and limiting said through opening at two ends thereof, said rotation-symmetrical bodies being supported between said opposite walls of said housing, one of said opposite walls along with one of said bodies supported thereon being pivotable so that, when a knot which is larger than said through opening reaches said through opening, said front wall is pivoted to send an actuating signal for automatic control of thread processing.

4. The knot catcher as defined in claim 3, further including an eccentric adjusting element which is eccentric to one of said axles, said one of said bodies supported on one of said opposite walls being connected to said eccentric adjusting element.

5. The knot catcher as defined in claim 4, wherein said one of said bodies is connected directly to said eccentric adjusting element.

6. The knot catcher as defined in claim 4, wherein said one of said bodies is connected indirectly to said eccentric adjusting element.

7. The knot catcher as defined in claim 3, wherein one of said opposite walls has a guide slot, the rotation axle of one of said bodies being adjustable in said guide slot and fixable therein.

8. The knot catcher as defined in claim 7, wherein the width of said slot is smaller than the width of each said rotation-symmetrical body.

9. The knot catcher as defined in claim 7, further including a switching-off device having a stationary switch, said one of said rotation-symmetrical bodies being adjustably supported relative to said switch and adapted to actuate the latter against the force of said restoring spring.

10. The knot catcher according to claim 3, further comprising a restoring spring connected with said one of said opposite walls which is pivotable.

11. The knot catcher according to claim 10, wherein one of said rotation axles is an adjusting axle on which one of said rotation-symmetrical bodies is mounted eccentrically.

12. A knot catcher for yarns and threads, comprising two elements adjustable relative to each other and forming between each other a thread-receiving through opening, said elements being two rotation-symmetrical bodies of which at least one is rotationally supported and at least one is adjustable relative to the other rotation-symmetrical body to adjust a size of said through opening for insertion of a thread thereinto, said two rotation-symmetrical bodies having cylindrical peripheral surfaces which form said through opening and rotation axles; and a housing including two opposite parallel flat walls between which said rotation-symmetrical are supported so as to be adjustable relative to each other.

13. The knot catcher according to claim 12, wherein one of said rotation axles is an adjusting axle on which one of said rotation-symmetrical bodies is mounted eccentrically.

14. The knot catcher as defined in claim 12, wherein said wall means are formed by two arms of a catcher support.

15. The knot catcher as defined in claim 12, further including a restoring spring and wherein one of said opposite walls supporting one of said bodies is pivotable against a force of said spring.

* * * * *